US005666723A

United States Patent [19]

Ohtaka et al.

[11] Patent Number: 5,666,723

[45] Date of Patent: Sep. 16, 1997

[54] METHOD OF PRODUCING CONNECTOR TERMINAL

[75] Inventors: Kazuto Ohtaka; Masakuni Samejima, both of Shizuoka, Japan

[73] Assignee: Yazaki Corporation, Tokyo, Japan

[21] Appl. No.: 426,668

[22] Filed: Apr. 21, 1995

[30] Foreign Application Priority Data

Apr. 22, 1994 [JP] Japan ..... 6-084389

[51] Int. Cl.[6] ..... H01R 43/16

[52] U.S. Cl. ..... 29/874; 29/882; 29/884

[58] Field of Search ..... 29/874, 882, 884

[56] References Cited

U.S. PATENT DOCUMENTS

| | | | |
|---|---|---|---|
| 3,058,091 | 10/1962 | Henschen | 29/874 X |
| 3,675,320 | 7/1972 | Watanabe | 29/874 |
| 4,857,019 | 8/1989 | Brubaker et al. | 29/874 X |
| 4,957,451 | 9/1990 | Nadin | 29/874 X |

FOREIGN PATENT DOCUMENTS

| | | | |
|---|---|---|---|
| 62-243265 | 10/1987 | Japan | H01R 13/187 |
| 63-124385 | 5/1988 | Japan | H01R 43/16 |
| 1155673 | 10/1989 | Japan | H01R 13/187 |
| 1571602 | 7/1980 | United Kingdom | 29/874 |

*Primary Examiner*—Carl J. Arbes

*Attorney, Agent, or Firm*—Sughrue, Mion, Zinn, Macpeak & Seas

[57] ABSTRACT

The invention relates to a connector terminal and a method of producing the same. The terminal, even if small in size, has a large allowable maximum deflection, and is excellent in durability, and the terminal of a one-part type can be produced from a relatively inexpensive thin metal sheet, thereby reducing the manufacturing cost. More specifically, the terminal is formed from a single thin metal sheet, and has a receptive portion and a spring portion formed at a front portion of a base plate for engaging with a mating terminal, and a wire connecting portion formed at a rear portion of the base plate. The thickness of the spring portion is smaller than that of the remainder of the terminal. In a shaping step of a process including blanking and pressing, only the spring portion is rolled into a thickness smaller than that of the remainder.

4 Claims, 8 Drawing Sheets

METHOD OF PRODUCING CONNECTOR TERMINAL

BACKGROUND OF THE INVENTION

1. Field of the Invention

This invention relates to a terminal for a connector used mainly for connecting wire harnesses in automobiles, and the invention also relates to a method of producing such a connector terminal.

2. Related Art

FIG. 8 shows the structure of one conventional connector terminal.

A receptive portion 2 and a spring portion 3 for a mating terminal are provided at a front portion of the terminal 1. The receptive portion is defined by a base plate 4, opposite side walls 5, and a top wall 6 which is formed by bending free end portions of the side walls 5 into overlapping relation to each other above the base plate 4. The spring portion 3 is formed by folding back the base plate 4 at the front end of the receptive portion 2, and is received in the receptive portion 2.

Conductor clamping portions 8 for electrical connection to a wire by compressive clamping or soldering, as well as insulator clamping portions 9 for mechanically gripping an insulative covering of the wire, are provided at a rear end portion of the terminal 1.

Such terminals are manufactured by sequential processing, using a pressing machine (not shown). Referring to FIG. 9, in the sequential processing, many steps including blanking and press-shaping are incorporated in a set of upper and lower press dies, and a blank 10 in the form of a thin metal sheet is sequentially fed step by step between the dies, and at a final stage of the process, a shaped product is discharged. Thus the blank 10 is processed into terminals 1, having a configuration shown in FIG. 8, merely by passing the blank 10 through the single pressing machine.

If the size of the terminal is made smaller in order to meet a demand in the market for a compact design of the terminal, the allowable maximum deflection of the spring portion 3 is smaller, and particularly when such a terminal is used in an automobile, there arises a serious problem in that durability, such as vibration resistance, is adversely affected.

Expressing this problem in terms of formulas, if the spring portion 3 is regarded as a cantilever beam of a concentrated load-type in FIG. 10, and if L represents the length of the beam, t represents a wall thickness, W represents the width of the spring portion 3, F represents a contact load of the terminal 1, E represents Young's modulus of a spring material, D represents the maximum deflection, and S represents the maximum stress, then known formulas (1) and (2) in connection with the strength of materials can be applied, and another formula (3) representing the maximum deflection D can be derived from the two formulas as follows:

$$D=12FL^3/3EWt^3 \quad (1)$$

$$S=6FL/Wt^2 \quad (2)$$

$$D=2SL^2/3Et \quad (3)$$

For increasing the allowable maximum deflection D in order to deal with the above problem, the following measures are suggested from the above formula (3):

1) To adopt such a configuration that the ratio of the dimension L to the overall size of the terminal is increased as much as possible.

2) To choose such a material for the spring portion that the allowable maximum stress S is large.

3) To reduce the thickness t of the spring portion.

To use a material with low Young's modulus is contrary to the intended purpose of the spring portion, and therefore this can not be adopted.

In one conventional method of increasing the effective length L of the spring (which is one of the above measures), a spring portion 3 has been formed into a coil spring-like configuration as shown in FIG. 11. In this method, however, the spring portion is complicated in structure, and also in order to stabilize the dimensional accuracy of the configuration, high precision techniques are required, which leads to a high manufacturing cost. A further drawback is that since a curved portion with a large radius is provided at the front end of the spring portion, the spring is susceptible to deformation due to prying by a tool.

With respect to a method of choosing a material with a large allowable maximum stress S, such a material is usually expensive, and if the whole of the terminal is formed of such a material, the manufacturing cost becomes high. If the whole of the terminal is formed of a material with a small thickness t, there is encountered a serious drawback in that the retaining strength to prevent rearward withdrawal of the terminal is decreased.

Therefore, there has heretofore been used a method in which a spring portion 3 is formed of a material different from that of the remainder of the terminal, or has a thickness different from that of the remainder, and the spring portion is formed in a separate process, and in a final step, the spring portion is mounted within a receptive portion 2 as shown in FIG. 13.

In the manufacture of such two-part terminal, however, different pressing machines as well as different press dies are required for pressing the spring portion 3 and the remainder, respectively, as shown in FIG. 12, and an assembling machine is further required. Therefore, the installation cost is increased, and the yield becomes low because of defective mounting of the spring portion.

In construction shown in FIG. 14, a connector terminal c, received in a terminal receiving chamber b of a connector housing a, is retained by an elastic retaining tongue d against rearward withdrawal. The connector terminal c includes a receptive portion e and a wire connecting portion f, and a retaining projection $d_1$ of the cantilever-type elastic retaining tongue d engages a retaining portion $e_1$ defined by a rear shoulder of the receptive portion e.

As shown on an enlarged scale in FIG. 15, the retaining portion $e_1$ has an edge $e_1'$ formed by a cut surface of a thin metal sheet, and a large retaining area p (the distance between the edge $e_1'$ of the retaining portion $e_1$ (i.e., the proximal contact end for the retaining projection $d_1$) and the distal end of the retaining projection $d_1$) can be provided, and a large part of a projection area q of the elastic retaining tongue d (the distance between the proximal end to the distal end of the retaining projection $d_1$) can be utilized. However, there is a drawback that the sharp edge $e_1'$ damages the retaining projection $d_1$.

In the construction shown in FIG. 16, a retaining portion $e_2$ of the terminal c is made bending a sheet, thereby providing an arcuate corner portion $e_2'$. In this case, because of the edgeless arrangement, damage to the elastic retaining tongue d can be prevented; however, because of the provision of the arcuate corner portion $e_2'$, the retaining area p' of the retaining portion $e_2$ for the retaining projection $d_1$ is reduced, and in order to ensure a satisfactory retaining effect, it is necessary to increase the retaining projection $d_1$ to increase a projection area q' as shown in phantom. However, the increased projection area leads to a disadvantage in that the overall size of the connector housing is increased.

SUMMARY OF THE INVENTION

This invention has been made in view of the above problems, and an object of the invention is to deal with the problems with parts (i.e., a spring portion and a retaining portion) of a the terminal, in the invention, the an integrally constructed spring portion and the retaining portion of a terminal are made thin, thereby overcoming such problems.

The above object has been achieved by a connector terminal integrally formed from a thin metal sheet by bending, characterized in that a localized, specific function portion for engagement with a mating terminal or a connector housing is than the rest of the metal sheet defined by a plate portion of a smaller thickness than the rest of the metal sheet.

The above object can be achieved by a connector terminal wherein the terminal is formed from a single thin metal sheet, and has a receptive portion and a spring portion formed at a front end portion of a base plate for engagement with a mating terminal, and a wire connecting portion formed at a rear portion of said base plate; and wherein the thickness of said spring portion is smaller than that of the remainder of said terminal.

The above object can be achieved by a connector terminal wherein a retaining portion of said connector terminal for abutment against a retaining projection of an elastic retaining tongue formed on a connector housing is defined by a folded end portion of a rolled thin plate portion at a superposed plate portion.

The above object can be achieved by a connector terminal wherein a folded plate portion defined by a rolled thin plate portion is formed at a front end of a wall constituting a receptive portion, thereby rendering the front end edgeless.

The above object has been achieved by a method of producing a connector terminal comprising the steps of rolling part of a terminal blank, blanked in a developed condition from a metal sheet, to form a rolled thin plate portion; and bending said terminal blank in the developed condition to form the terminal, and processing said rolled thin plate portion to form a specific function portion for engagement with a mating terminal or a connector housing.

The above object can be achieved by a method of producing a connector housing having a receptive portion and a spring portion formed at a front portion of a base plate for engaging with a mating terminal, said terminal being formed by a process including blanking from a single thin metal sheet and pressing; only a spring portion is rolled into a thickness smaller than that of the remainder of said terminal.

The above object can be achieved by a method of producing a connector housing comprising the steps of rolling part of a metal terminal blank, blanked in a developed condition from a thin metal sheet, to form a rolled thin plate portion, and folding back said rolled thin plate portion to form a folded plate portion; and bending said metal terminal blank in the developed condition to form the metal terminal, thus rendering an end of said folded plate portion edgeless.

The specific function portion, formed by the thin plate portion to serve as the spring portion, can have a large allowable maximum deflection, whereas the specific function portion serving as the retaining portion can be made edgeless by bending the thin plate portion in a small range.

DESCRIPTION OF THE PREFERRED EMBODIMENTS OF THE INVENTION

Figure 1:
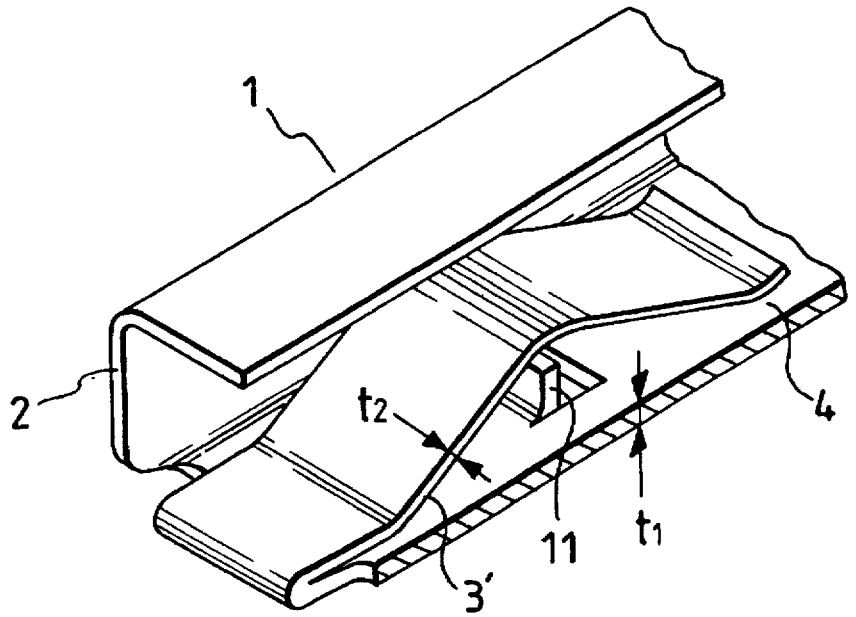
FIG. 1 is a perspective view of an important portion of one preferred embodiment of a connector terminal of the present invention.

FIG. 1 is a perspective view of an important portion of a connector terminal of the present invention, and those portions similar to those of the conventional terminal are designated by identical reference numerals, and explanation thereof will be omitted.

A receptive portion 2 and a spring portion 3' for a mating terminal are provided at a front portion of a base plate 4 of the terminal 1, and the spring portion 3' is formed by folding back the base plate 4 at the front end of the receptive portion 2, and is received in the receptive portion 2.

The thickness $t_2$ of the spring portion 3' is smaller than the thickness $t_1$ of the remainder of the terminal 1, and with this arrangement an allowable maximum deflection of the spring portion 3' can be kept at a high level without decreasing the strength of the remainder of the remaining portions of the terminal.

The spring front end portion is defined by the folded portion constituted by opposed portions held in intimate contact with each other, and with this construction the spring portion is prevented from being deformed by prying.

In the construction shown in FIG. 1, although a projection 11 stamped from the base plate 4 prevents a permanent set of the spring portion 3' in fatigue due to excessive deflection thereof, the provision of the projection 11 may be omitted.

Figure 2:
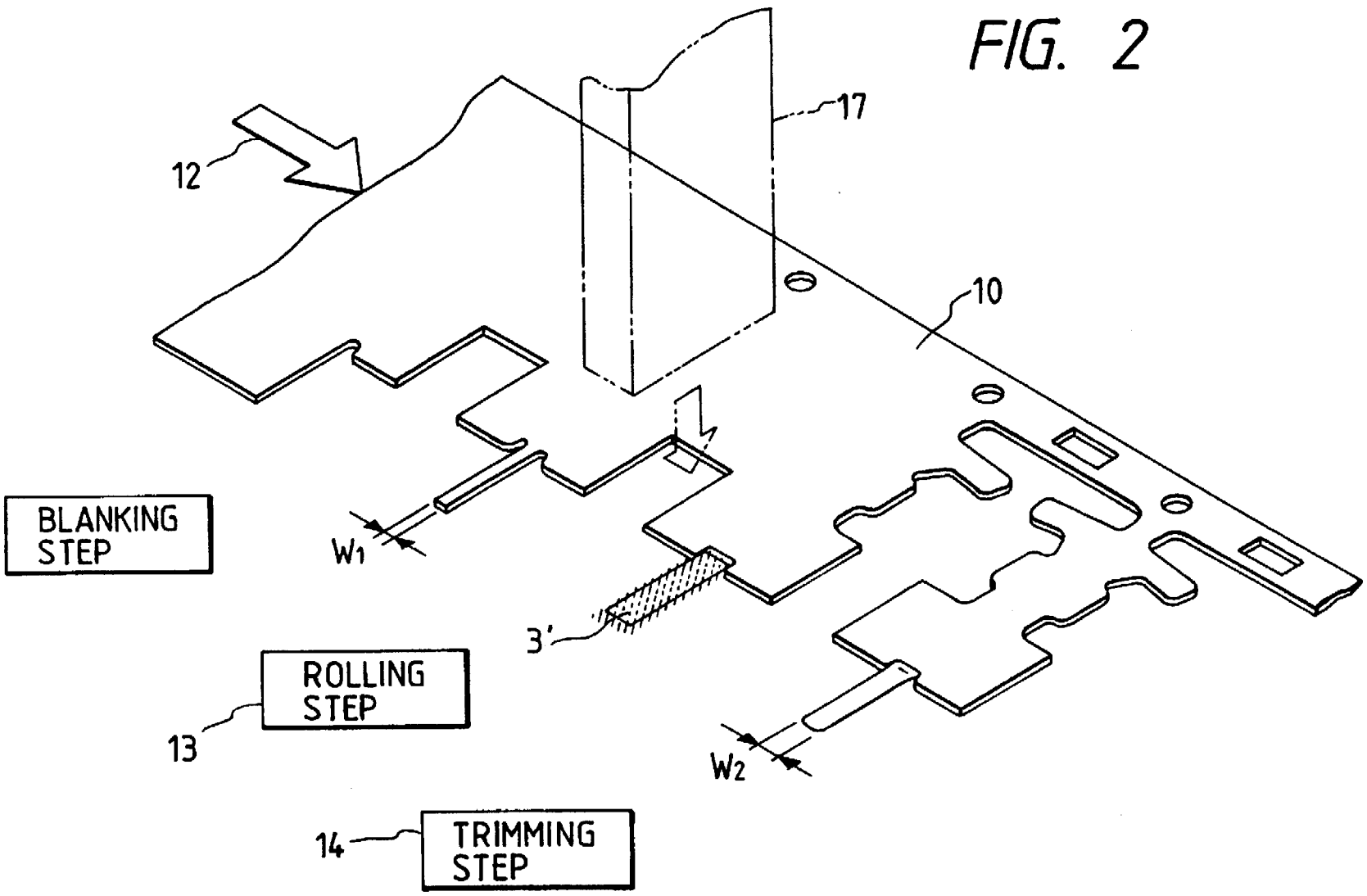
FIG. 2 is a view showing sequential processing in a terminal producing method of the invention.

FIG. 2 shows sequential processing of the invention by a press for producing the terminal having the above features.

A blank 10 comprising a thin metal sheet is sequentially fed step by step between a set of upper and lower dies (not shown) in a direction of arrow 12, and undergoes a multi-stage process, and finally is fed out as the terminal shaped into a predetermined configuration. In the present invention, a rolling step 13 is incorporated in the above dies, and in this rolling step, only the spring portion 3' is rolled into a smaller thickness than that of the remainder.

The rolling step 13 is carried out using a hammer 17 (shown in phantom in FIG. 2), mounted on one of the dies, and an anvil (not shown) mounted on the other die disposed in opposed relation to the one die, and when the press is operated, the gap between the hammer 17 and the anvil is such that only the spring portion 3' is rolled into a predetermined thickness.

As a result of rolling, the outer shape of the spring portion 3' is expanded as compared with the width $W_1$ of the spring portion 3' in a blanking step, and therefore in order to obtain accurate finish dimensions, it is preferred that a trimming step 14 (in which a width $W_2$ is obtained) for trimming the outer shape of the spring portion 3' be provided after the rolling step 13.

To achieve the above terminal construction, the following method is used. The terminal is formed from a single thin metal sheet by sequential processing (which includes blanking, pressing and so on) by the pressing machine, and the rolling step and a rolling machine for making only the thickness of the spring portion smaller than that of the remainder are incorporated in the sequential processing dies.

The terminal produced by the above means has a large allowable maximum deflection even if the terminal is of a small size, and therefore even in an environment subjected to large vibrations, the durability of the terminal is enhanced.

And besides, since a curved portion with a large radius is not provided at the front end of the spring, there is no risk that the spring could be deformed due to prying by a tool.

Furthermore, since the terminal is of a one-part construction formed from the single thin metal sheet through blanking and pressing, disadvantages such as an increased assembly cost and a decreased yield due to an additional separate process are overcome.

Since the step of rolling only the spring portion into a thickness smaller than that of the remaining portions is incorporated in the sequential-processing press dies, the reduced thickness of the spring portion will not affect the other portions, and hence will not lower the strength. Additionally simplification of the process, saving of assembly cost and an increased yield inherent to the one-part construction (in which the terminal is formed from the single thin metal sheet) can be achieved.

Figure 3:
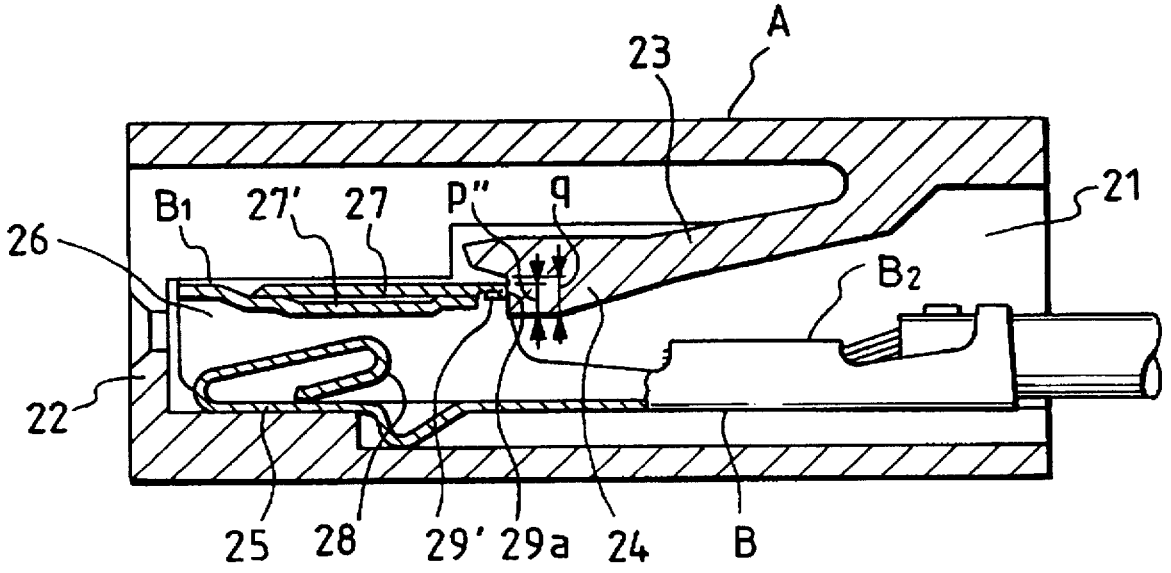
FIG. 3 is a cross-sectional view of a modified version of the invention.

In FIG. 3, reference numeral A denotes a connector housing of a synthetic resin, and reference numeral B denotes a metal terminal. The connector housing A has a terminal receiving chamber 21 extending therethrough in a forward-backward direction, and a stopper 22 is provided at a front end of the terminal receiving chamber 21, and an elastic retaining tongue 23 of the cantilever-type is provided at an intermediate portion of this chamber. A retaining projection 24 having a projection area q is formed at a free end of the elastic retaining tongue 23.

The metal terminal B includes a receptive portion $B_1$ and a wire connecting portion $B_2$, and a wire is beforehand connected to the wire connecting portion $B_2$.

Figure 4A:
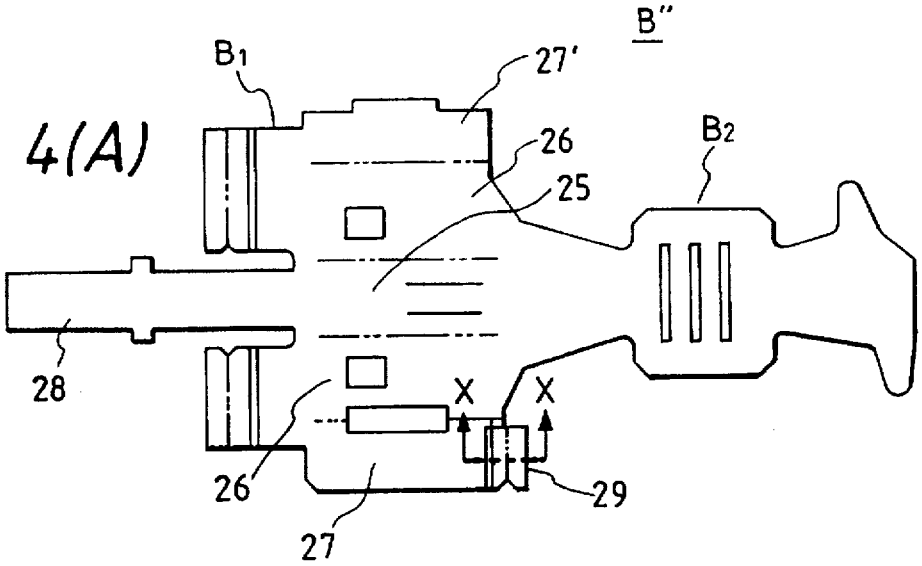
FIGS. 4(A) and 4(B) are developed views of the metal terminal of FIG. 3.
Figure 4B:
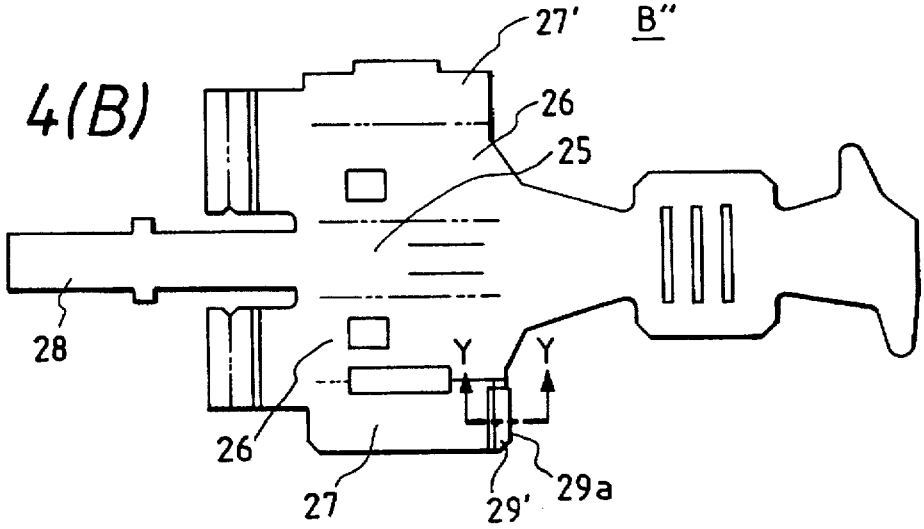
Figure 5A:
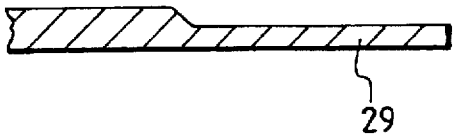
FIG. 5A is a cross-sectional view taken along the line X—X of FIG. 4(A)
Figure 5B:
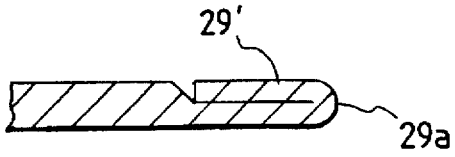
FIG. 5B is a cross-sectional view taken along the line Y—Y of FIG. 4(B)

In the receptive portion $B_1$, superposed top plate portions 27 and 27' are formed on a bottom plate portion 25 through opposite side plate portions 26 and 26, and a folded, resilient contact portion 28 is formed at a front end of the bottom plate portion 25. In a metal terminal blank B" blanked in a developed condition from a thin metal sheet, a rolled thin plate portion 29, projecting rearwardly from the inner top plate portion 27', is first formed at a rear end of the outer top plate portion 27 (FIGS. 4(A) and 5(A)). Then, the rolled thin plate portion 29 is folded forwardly to form a folded plate portion 29', so that an edgeless retaining portion **29*a* is formed at a rear end of the folded plate portion 29' (FIGS. 4(B) and 5**(B)). In this way, the metal terminal B is formed by bending.

Figure 15:
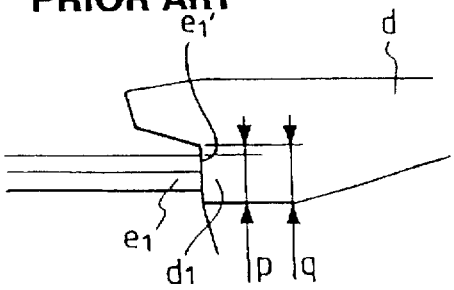
FIG. 15 PRIOR ART
FIG. 15 is an enlarged view of an important portion of the construction of FIG. 14.
Figure 16:
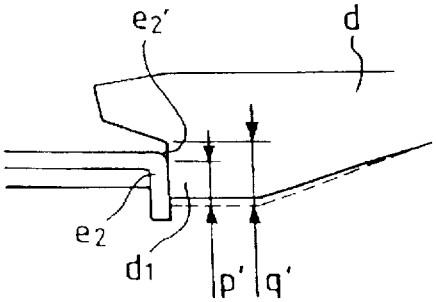
FIG. 16 PRIOR ART
FIG. 16 is a cross-sectional view of an important portion of another conventional retaining construction.

As described above, the retaining portion **29*a* of the metal terminal B is formed by folding the rolled thin plate portion 29, so that the arcuate corner portion can be of a small size. Therefore, a retaining area p" of the edgeless retaining portion 29*a* for abutment against the retaining projection 24 can be made generally equal to the retaining area p (see FIG. 15**) for the conventional edge-forming retaining portion.

Figure 6:
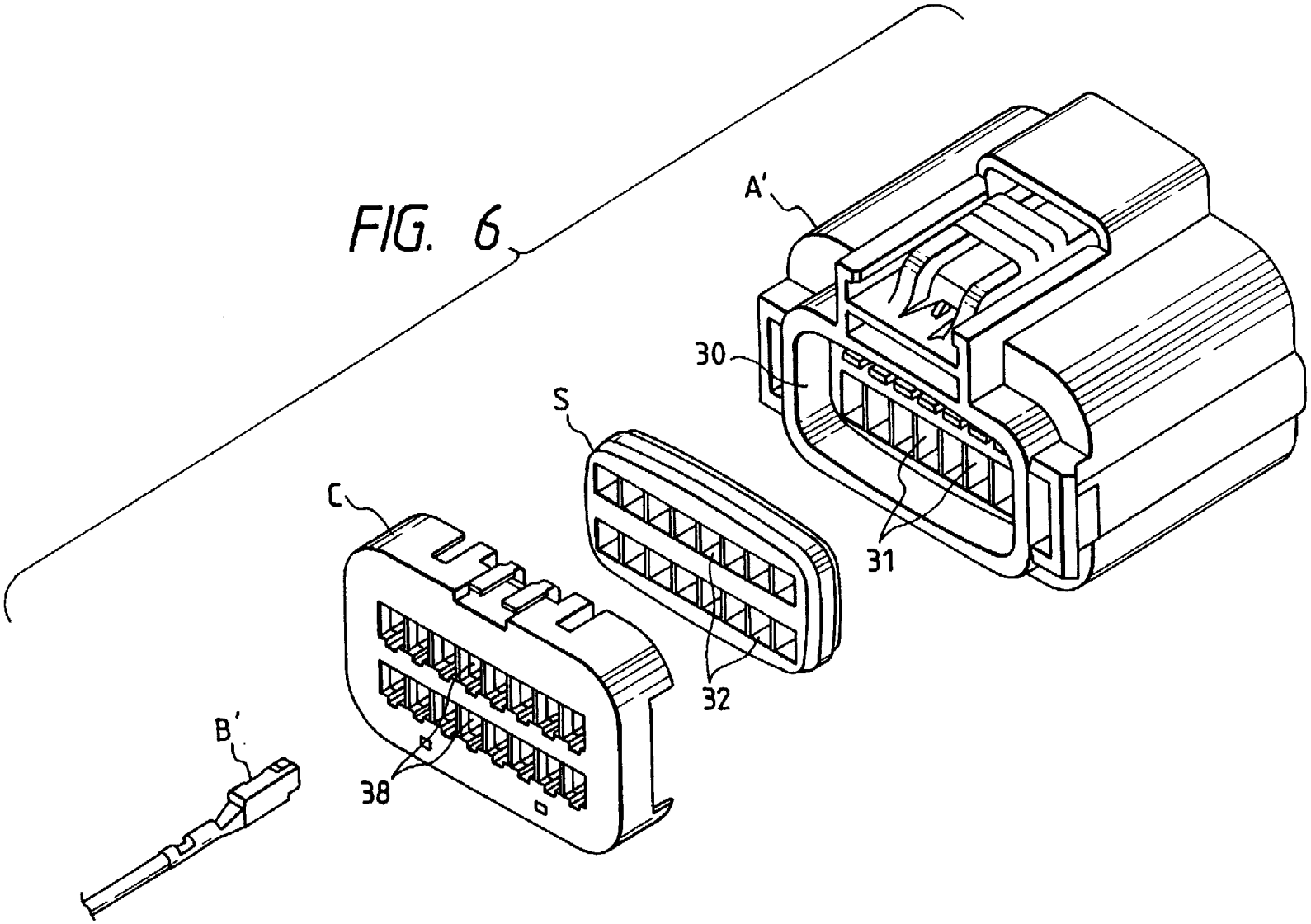
FIG. 6 is an exploded, perspective view of a waterproof connector.

FIG. 6 shows a waterproof connector housing A', a mat-like waterproof plug S, a waterproof plug holder cover C, and a waterproof connector terminal B'. The waterproof plug S for fitting in an open chamber 30 in a rear end of the connector housing A' has a plurality of seal insertion holes 32 corresponding respectively to terminal receiving chambers 31. The waterproof plug S is beforehand fitted in the open chamber 30, and is fixed by the waterproof plug holder cover C, and in this condition the terminal B' connected to a wire is passed through an associated through hole 38 in the waterproof plug holder cover C and the associated insertion hole 32, and is inserted into the associated terminal receiving chamber 31, and is retained there.

Figure 7:
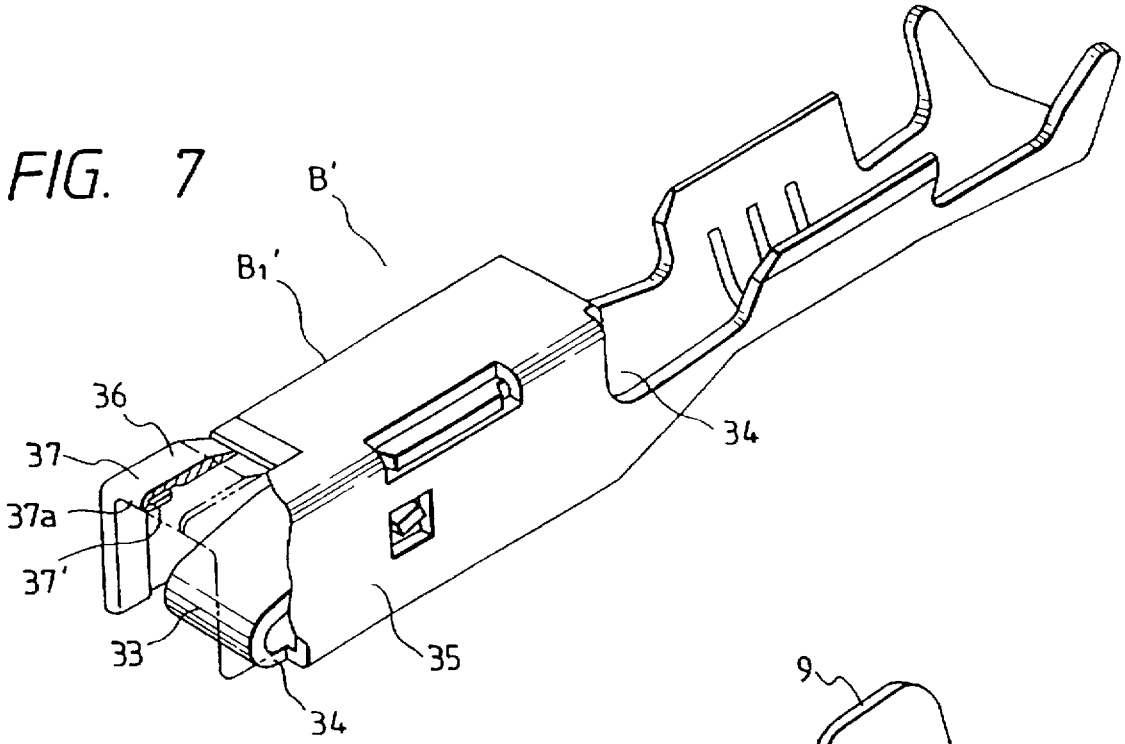
FIG. 7 is a perspective view of another modified version of the invention.
Figure 8:
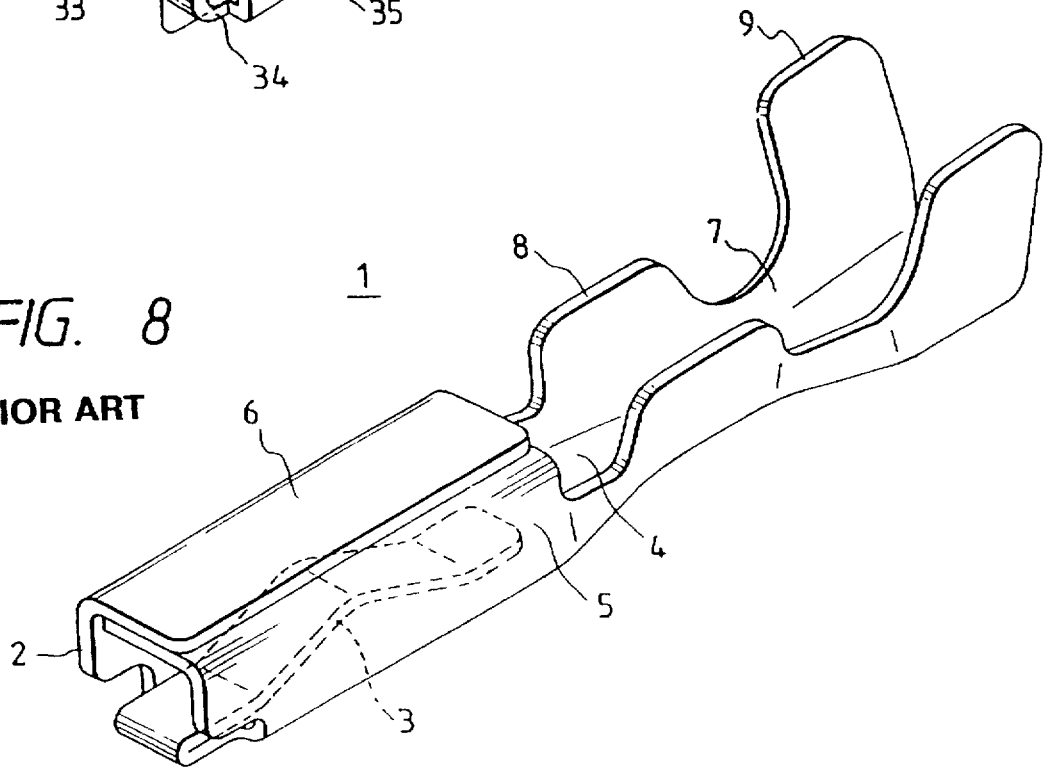
FIG. 8 PRIOR ART
FIG. 8 is a perspective view of a conventional terminal.
Figure 9:
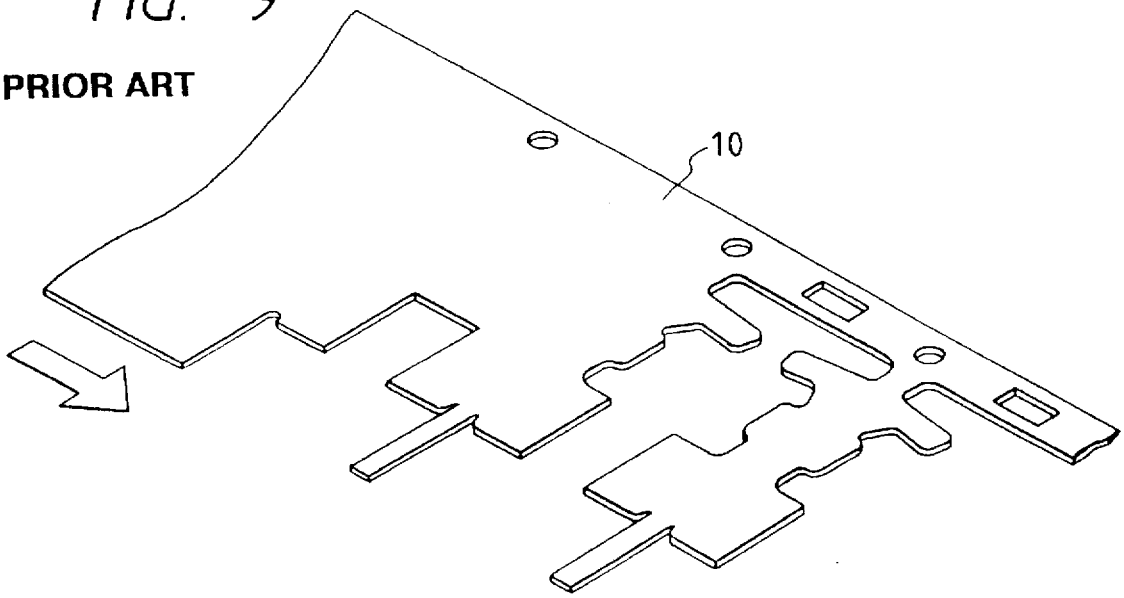
FIG. 9 PRIOR ART
FIG. 9 is a view showing sequential processing in a method of producing the conventional terminal.
Figure 10:
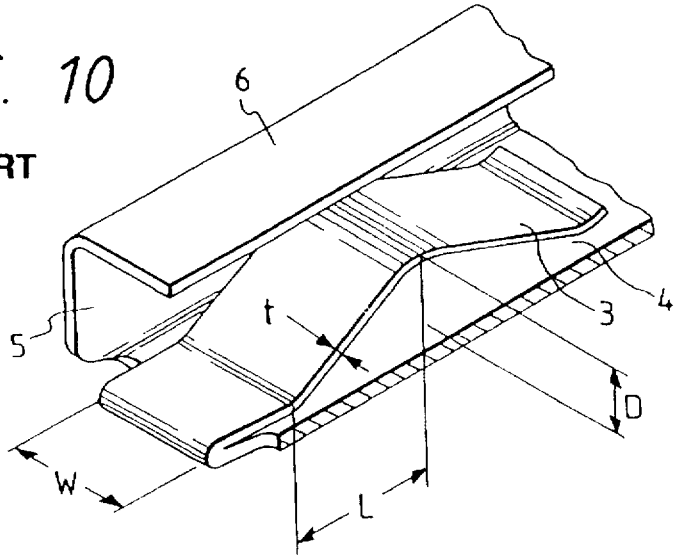
FIG. 10 PRIOR ART
FIG. 10 is a perspective view of an important portion of the conventional terminal.
Figure 11:
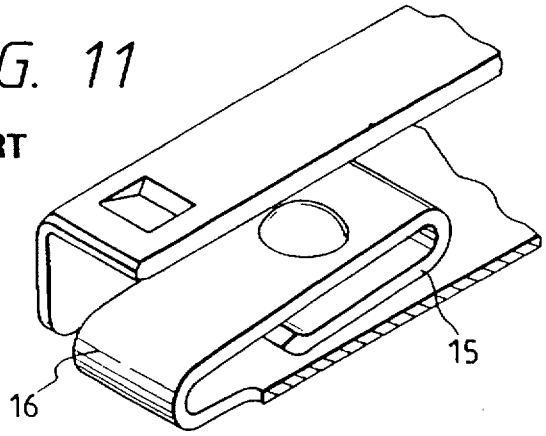
FIG. 11 PRIOR ART
FIG. 11 is a perspective view of an important portion of another conventional terminal, showing the construction of a spring portion.
Figure 12:
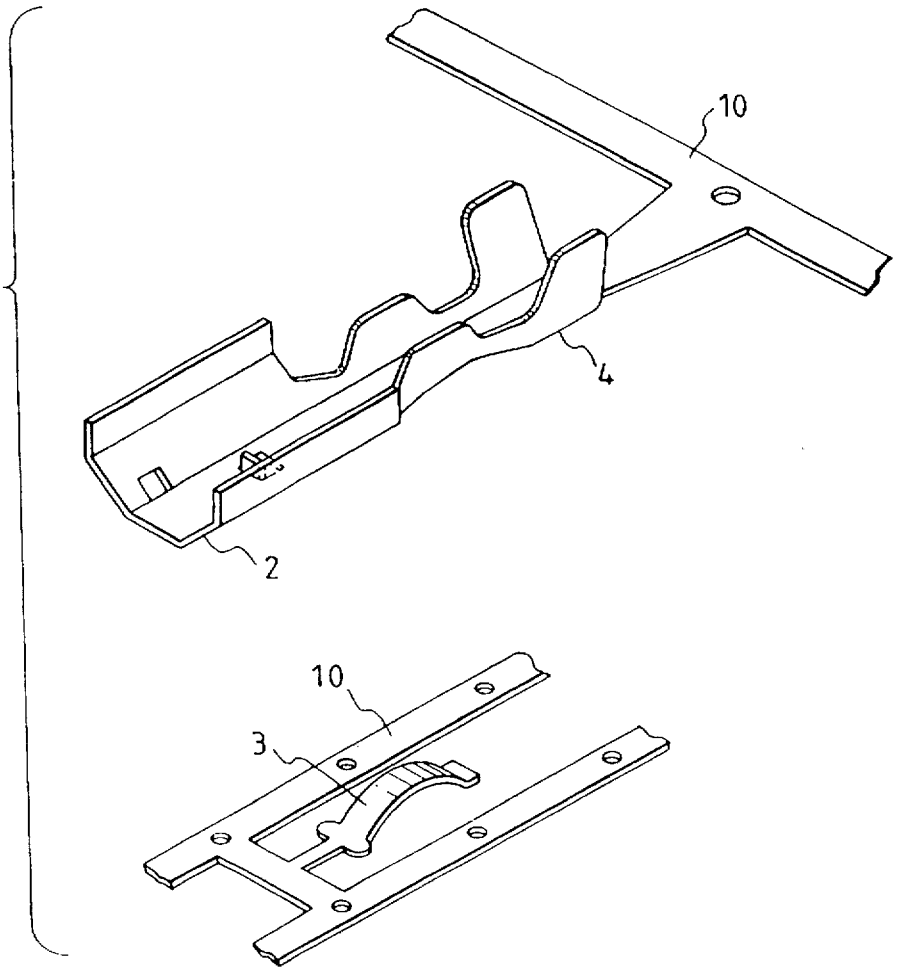
FIG. 12 PRIOR ART
FIG. 12 is a view showing a process of producing a conventional two-part terminal.
Figure 13:
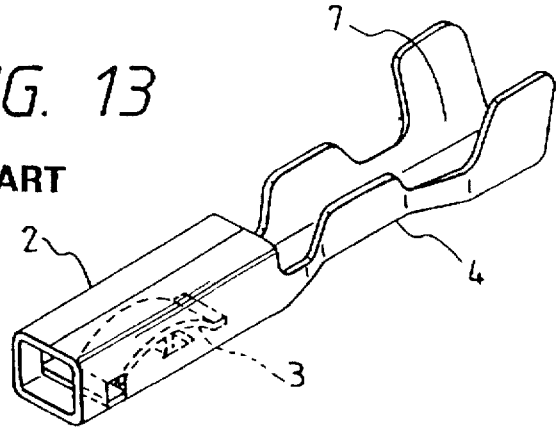
FIG. 13 PRIOR ART
FIG. 13 is a perspective view of the conventional two-part terminal.
Figure 14:
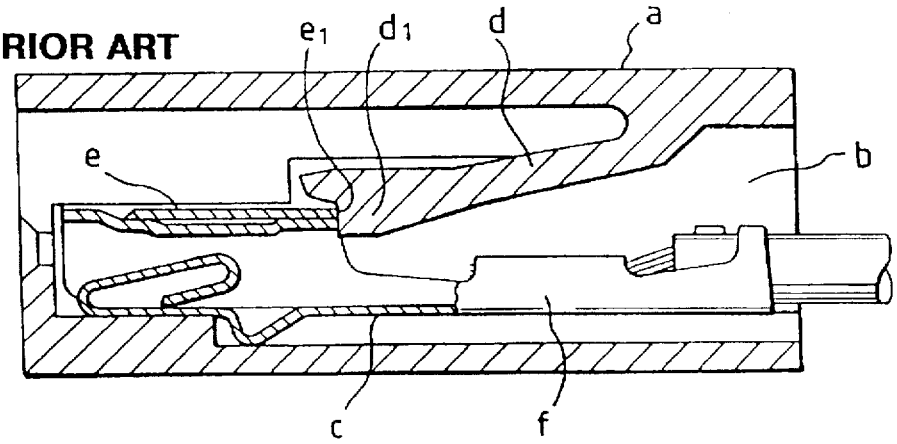
FIG. 14 PRIOR ART
FIG. 14 is a cross-sectional view showing a conventional terminal retaining construction.

When the terminal B' is passing through the seal insertion hole 32 while expanding this hole, there is a fear that a front edge (not shown) of a receptive portion $B_1'$ of the terminal B' may damage the insertion hole portion 32 to adversely affect sealing performance. Therefore, a rolled thin plate portion 37 as described above (see FIG. 7) is formed at front ends of side walls 35 and an upper wall 36 except for a base plate 34 having a spring portion 33 formed thereon, and then this rolled thin plate portion 37 is folded to form a folded plate portion 37'. By doing so, an edgeless front end **37*a*** can be formed in a compact manner without particularly increasing the size of the terminal.

The connector terminal of the present invention has a large allowable maximum deflection even if the terminal is of a small size, and therefore even in an environment subjected to large vibrations, the durability of the terminal is good, and since a curved portion with a large radius is not provided at the front end of the spring, there is no risk that the spring will be deformed due to prying by a tool. Thus, reliability in electrical connection is high, and also a technical value is high.

In the connector terminal of the present invention, the folded plate portion, formed by the rolled thin plate portion, is provided at part of the terminal, thereby rendering the relevant portion edgeless. Therefore, without particularly increasing the size of the terminal, there can be obtained a terminal which will not damage the retaining portion of the connector housing, as well as the seal hole portion of the waterproof plug.

In the method of the present invention, the step of rolling only the spring portion into a thickness smaller than that of the remainder is incorporated in the sequential-processing press dies for producing the connector terminal. With this arrangement, the reduced thickness of the spring portion will not affect the overall structure, and hence will not lower the strength, and since the one-part terminal can be produced from a relatively inexpensive thin metal sheet, simplification of the process, saving of assembly cost and an increased yield can be achieved, thus providing great advantages from the viewpoint of cost.

What is claimed is:

1. A method of producing a connector terminal having an enclosed receptive portion and a spring portion formed at a front portion of a base plate for engaging with a mating terminal, comprising the steps of:

blanking a thin metal sheet into a terminal blank including said spring portion and a pair of opposing side portions;

rolling only said spring portion into a thickness smaller than that of the remainder of said terminal blank;

bending said pair of opposing side portions to form said enclosed receptive portion; and bending said spring portion such that said spring portion is disposed within said enclosed receptive portion.

2. A method of producing a connector terminal according to claim 1, further comprising the step of trimming the outer edges of said spring portion after said rolling step.

3. A method of producing a connector terminal according to claim 1, wherein said step of bending said spring portion is performed before said step of bending said opposing side portions.

4. A method of producing a connector terminal having a receptive portion into which a mating terminal is insertable, comprising the steps of:

blanking a thin metal sheet to form a terminal blank including said receptive portion;

rolling part of said terminal blank to form a rolled thin plate portion at an end of said receptive portion;

folding back said rolled thin plate portion upon itself to form a folded plate portion defining an entryway of said receptive portion; and bending said terminal blank to form connector terminal, thereby rendering said end of said receptive portion smooth.

* * * * *